US005718661A

United States Patent [19]

Michalik

[11] Patent Number: 5,718,661

[45] Date of Patent: Feb. 17, 1998

[54] FOLDING ROLLER FOR ROTARY PRINTING PRESS

[75] Inventor: Horst Bernhard Michalik, Höchberg, Germany

[73] Assignee: Koenig & Bauer-Albert Aktiengesellschaft, Wurzburg, Germany

[21] Appl. No.: 772,133

[22] Filed: Dec. 20, 1996

[30] Foreign Application Priority Data

Dec. 27, 1995 [DE] Germany ..... 195 48 814.8

[51] Int. Cl.[6] ..... B65H 45/22

[52] U.S. Cl. ..... 493/439; 493/476

[58] Field of Search ..... 493/416, 439, 493/442, 443, 471, 476

[56] References Cited

U.S. PATENT DOCUMENTS

| | | | |
|---|---|---|---|
| 1,714,785 | 5/1929 | Hudson . | |
| 1,884,783 | 10/1932 | Marcalus . | |
| 2,094,415 | 9/1937 | Schwartz | 493/439 |
| 3,442,504 | 5/1969 | Halley | 493/442 |
| 3,545,371 | 12/1970 | Reist | 493/442 |
| 4,300,895 | 11/1981 | Meenen | 493/416 |
| 4,666,423 | 5/1987 | Herrington | 493/439 |

FOREIGN PATENT DOCUMENTS

| | | |
|---|---|---|
| 28 08 483 | 9/1978 | Germany . |
| 37640 | 4/1986 | Germany . |
| 44 28 593 | 5/1995 | Germany . |

*Primary Examiner*—Jack W. Lavinder
*Attorney, Agent, or Firm*—Jones, Tullar & Cooper, P.C.

[57] ABSTRACT

A funnel folding roller pair cooperate to form a folding roller gap in a longitudinal paper web fold former. The folding rollers also act as supports for paper web draw-in guide belts. Each folding roller is comprised of spaced folding roller elements which are spaced apart by belt guides for the paper web draw-in guide belts. Each funnel folding roller is shiftable under the control of a computer to set a desired folding roller gap spacing.

15 Claims, 3 Drawing Sheets

FOLDING ROLLER FOR ROTARY PRINTING PRESS

FIELD OF THE INVENTION

The present invention is directed generally to a folding roller assembly for a rotary printing press. More particularly, the present invention is directed to a funnel folding roller assembly for the longitudinal folding funnel of a folding apparatus of a web-fed rotary printing press. Most specifically, the present invention is directed to a funnel folding roller assembly of a longitudinal folding funnel of a folding apparatus in which the gap spacing between the two folding rollers is adjustable. The folding rollers are each supported at their ends in sliding pads that are supported between upper and lower sliding pad guides. Each sliding pad is movable between the spaced pad guides by the operation of a suitable servo motor and a threaded spindle. The positions of the two folding rollers for any particular production set-up can be stored in the memory of a computer so that the folded gap spacing of the funnel folding rollers can be re-set.

DESCRIPTION OF THE PRIOR ART

In the field of web-fed rotary printing, a paper web is typically printed in a configuration in which several different pages of print are arranged across the width of the web. The printed web is then longitudinally folded by being passed through a longitudinal former and folder. In many instances, a plurality of longitudinally extending web sections will be placed atop each other prior to being passed through the longitudinal former and folder. Such a longitudinal former and folder is frequently generally in the shape of a funnel or trough in which the longitudinal edges of the web or superimposed webs are formed or folded so that they exit the longitudinal folding funnel generally adjacent each other. In such longitudinal folding devices, it is often appropriate to place a pair of folding rollers at the discharge end of the longitudinal folder. This folding roller pair has a defined folding gap width and acts to form a longitudinal crease or fold generally at the longitudinal center line of the formed or folded paper web.

In the German Patent Publication DE 28 08 483 A1 there is shown a device in which a folding roller pair is disposed at the outlet of a longitudinal folding funnel. The folding roller pairis used to make a longitudinal fold in a running paper web as it exits from the longitudinal folder. The folding rollers are driven by frictional contact with the running paper web train that is moving over the surface of the folding rollers.

The prior funnel folding rollers do not readily accommodate various thicknesses of longitudinally folded running webs. They are also typically not provided with positive drive arrangements and thus are apt to slip with respect to the printed web. It will thus be seen that a need exists for an arrangement of folding rollers that overcomes the limitations of the prior art. The folding roller assembly for the longitudinal folder of a rotary printing press in accordance with the present invention provides such a device and is a significant improvement over the prior art.

SUMMARY OF THE INVENTION

It is an object of the present invention to provide a folding roller assembly for a rotary printing press.

Another object of the present invention is to provide a folding roller assembly for a longitudinal folding funnel of a web-fed rotary printing press.

A further object of the present invention is to provide a funnel folding roller assembly for a rotary printing press in which a folding gap of the roller assembly is adjustable.

Still another object of the present invention is to provide a folding roller pair in which both of the folding rollers are independently driven.

Yet a further object of the present invention is to provide a folding roller assembly in which at least one of the rollers supports an independently rotatable guide for a paper web lead-in belt.

Even still an additional object of the present invention is to provide a funnel folding roller assembly in which each roller is divided along its length.

As will be discussed in detail in the description of the preferred embodiment which is presented subsequently, the funnel folding roller assembly in accordance with the present invention is situated at the downstream or exit end of a longitudinal funnel former or folder. The folding roller assembly includes a pair of rollers that are each independently driven and that are supported for movement toward and away from each other to vary their folding roller gap. A servo motor and threaded screw is used to adjust the position of each end of each of the two folding rollers. These servo motors are controlled by a suitable computer that is provided with a memory. The memory is capable of storing positional information for each servo motor with respect to a specific production set-up. If the same production is to be run again, the servo motors will be actuated to again place the folding rollers in the appropriate spacing.

Each of the folding rollers is comprised of several spaced roller segments. These segments are separated by roller bearings that support paper web draw-in guide belt. These guide belts can be either flat or round belts and serve to direct the paper to the roller gap formed by the two cooperating funnel folding rollers. The roller bearings guide and support these belts.

A particular advantage of the folding roller assembly for the longitudinal former and folder of a rotary printing press in accordance with the present invention is the drastic reduction in down time or press set-up time that it makes possible. As discussed above, each of the ends of the two folding rollers is supported by a sliding pad that is shiftable between upper and lower sliding pad guides. The sliding pads are each shifted by individual servo motors that each drive a threaded rod. The positional information for each sliding pad, as a function of numbers of revolutions of each servo motor is stored in the memory of a suitable computer. This insures that the folding roller pair can be spaced to define a particular folding roller gap which can be easily re-set to the same gap if the same production set-up is again desired. The desired folding gap can be set remotely by causing the computer to operate each servo motor for the desired number of revolutions, as determined by the desired production set-up.

The folding roller assembly for a rotary printing press in accordance with the present invention overcomes the limitations of the prior art devices. It is a substantial advance in the art.

BRIEF DESCRIPTION OF THE DRAWINGS

While the novel features of the funnel folding roller assembly for a rotary printing press in accordance with the present invention are set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
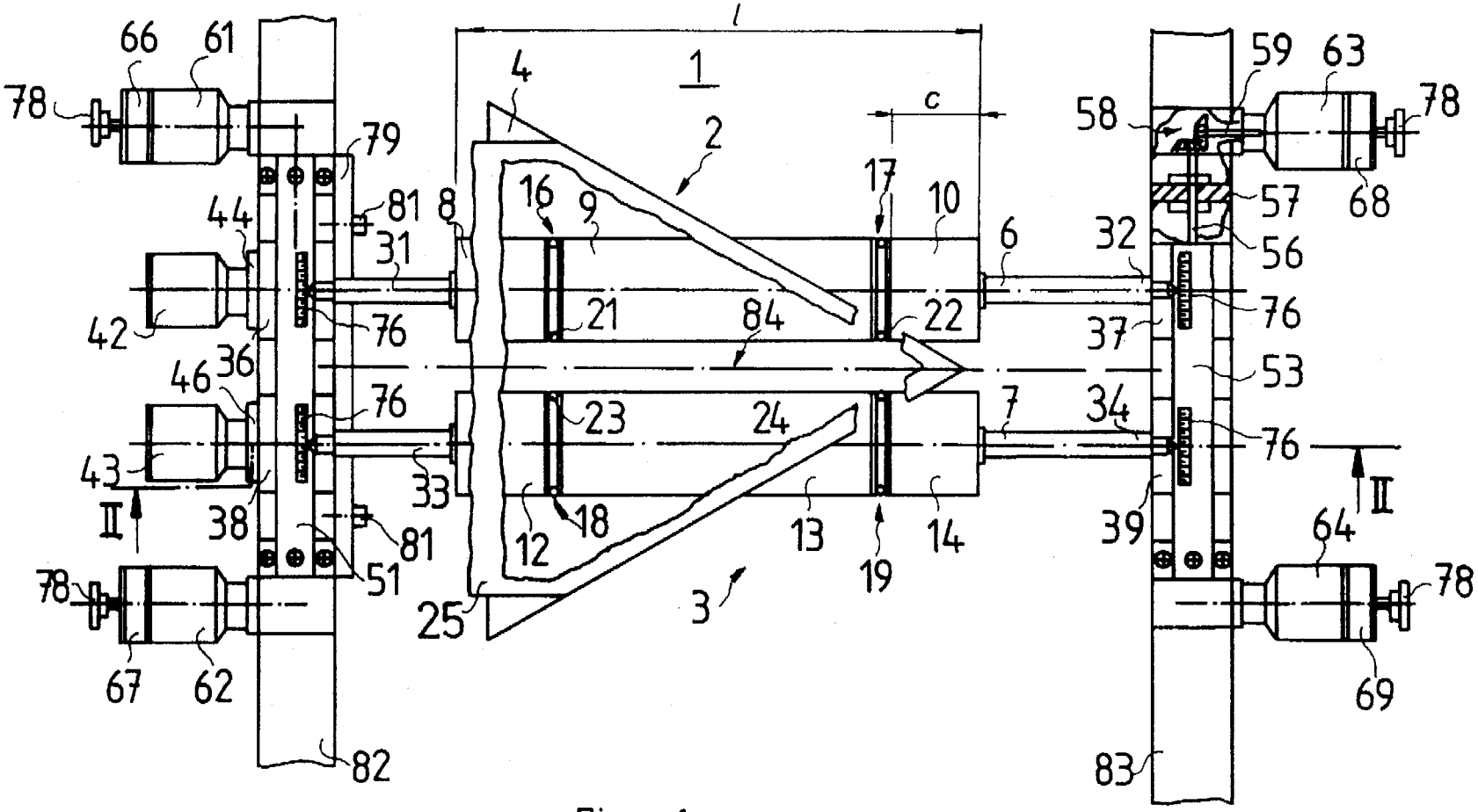
FIG. 1 is a top plan view of a folding roller group in accordance with the present invention.
Figure 2:
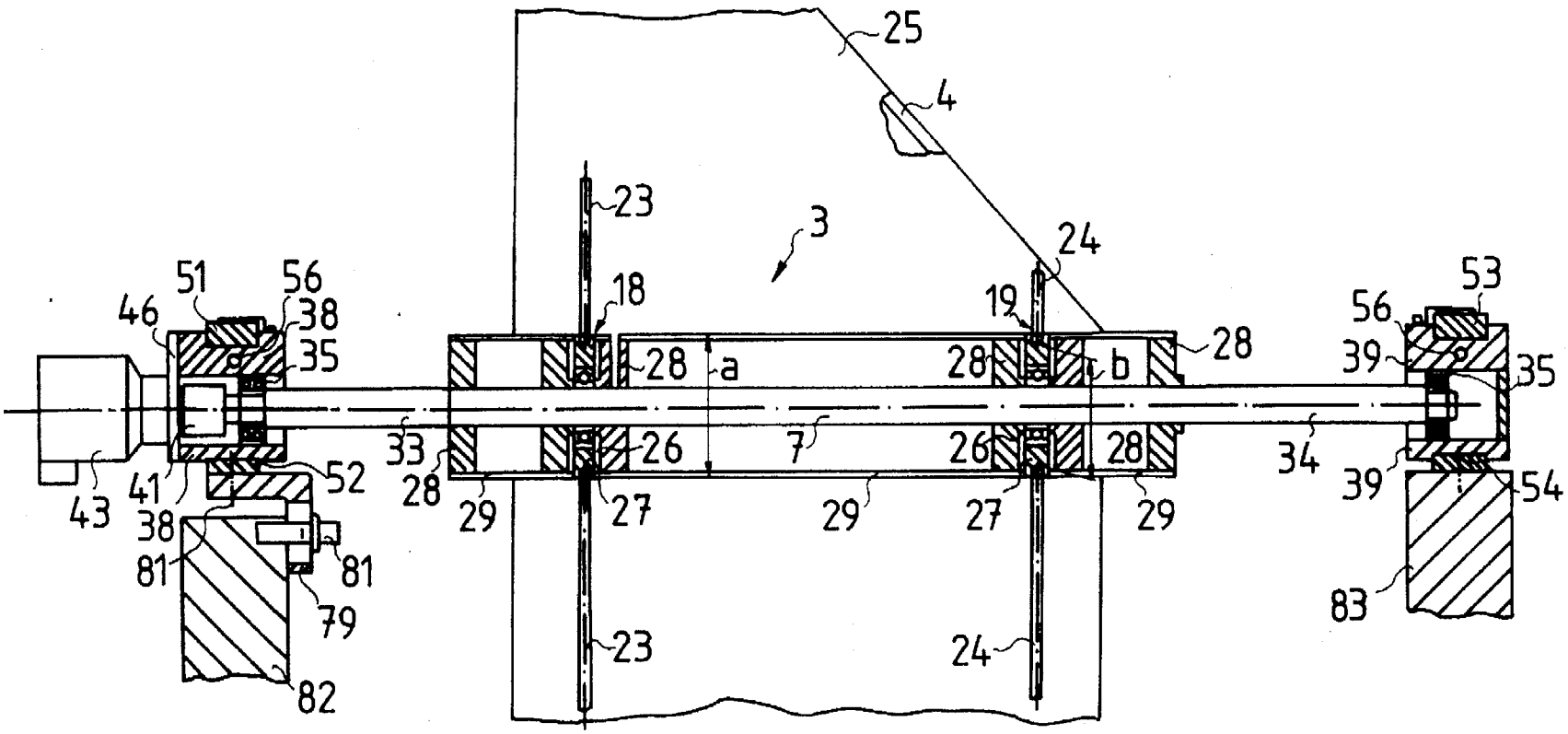
FIG. 2 is a longitudinal sectional view of the folding roller group of FIG. 1 and taken along line II—II.

Referring initially to FIG. 1, and taken in conjunction with FIG. 2, there may be seen generally at 1 a funnel folding roller assembly for use with a rotary web-fed printing press in accordance with the present invention. The folding roller group or assembly 1 is comprised of two spaced, generally parallel funnel folding rollers 2 and 3. These two folding roller 2 and 3 are situated at the downstream end or outlet of a longitudinal folding funnel 4. The purpose of the folding funnel 4 or longitudinal folder is to form a longitudinal fold in a paper web 25 which has previously been printed by one or more printing couples that are located upstream of the longitudinal folder 4. The two folding rollers 2 and 3 define a folding gap through which the longitudinally formed web passes.

As may be seen in FIGS. 1 and 2, each funnel folding roller 2 and 3 is divided along its axial length into a plurality of funnel folding roller elements. Roller 2 is divided into roller elements 8, 9 and 10. While roller 3 is divided into elements 12, 13 and 14. These roller elements are each interlockingly connected next to each other in the axial direction on drivable shafts 6 and 7, respectively. Thus folding roller elements 8, 9 and 10 are connected to drivable shaft 6 whereas folding roller elements 12, 13 and 14 are secured to drivable shaft 7. Securement may be accomplished by suitable set screws or other fasteners.

A number of freely rotatable paper web draw-in belt guides 16 and 17 or 18 and 19 are disposed on shafts 6 and 7, respectively. Each of these paper web draw-in belt guides 16 and 17 or 18 and 19 are used to guide and to support a cooperating paper web draw-in guide belt, such as flat or round belts 21 and 22 or 23 and 24, respectively. These guide belts are used to direct a paper web 25, which exits from the longitudinal folder or former 4, to the funnel folding roller assembly 1. Each guide belt 21, 22 or 23, 24 is carried by its respective belt guide 16, 17 or 18, 19 with each such belt guide being disposed between two axially spaced folding roller elements 8 and 9 or 9 and 10 on shaft 6; or folding roller elements 12 and 13 or 13 and 14 on shaft.

As may be seen most clearly in FIG. 2, each of the paper web draw-in belt guides 16 to 19 is a roller bearing 26 that has an inner race which is secured to its associated shaft. Each of the inner races of these belt guide roller bearings 26 is of a first width which is selected so that the spaced side faces of the inner race of each belt guide roller bearing 26 will engage the end faces of the associated folding roller elements 8 and 9, 9 and 10, 11 and 12 or 12 and 13 between which each belt guide roller bearing 26 is situated. An outer race of each of the draw-in belt guide roller bearings 26 can be connected in an interlocking manner with a belt roller 27. Each of these belt rollers 27 supports and guides one of the paper web draw-in guide belts 21, 22, 23 or 24. To insure proper guide belt retention, each belt roller 27 can be provided with suitable spaced lateral rims. It will be appreciated that the outer race of each of the ball bearings 26 will be narrower in width than the inner race of the associated ball bearing 26. Thus each belt roller 27 is supported for free rotation between its associated folding roller elements 8, 9 and 10 or 12, 13 and 14. As may be seen most clearly in FIG. 2, an external diameter "a" of each funnel folding roller 2 or 3 is greater than an outer diameter "b" of each belt roller 27. This insures that the various paper web guide-in belts 21–24 will not project beyond the surface of their associated folding roller elements 8, 9 and 10 or 12, 13 and 14.

Each of the several folding roller elements 8, 9 and 10 or 12, 13 and 14 carried by its respective drivable shaft 6 or 7, is constructed of two spaced apart disc or circular-shaped support plates 28 and a generally cylinder shaped shell 29. The support plates 28 are joined to the ends of the cylinder shaped shell 29 for each folder roller elements 8, 9 or 10 or 12, 13 or 14. Each of these folding roller elements 8 , 9 or 10 or 12, 13 or 14 is clamped in place by use of, for example an attachment screw or screws on its associated shaft 6 or 7. Each of these funnel folding rollers 2 and 3 has a length "l" and this length "l" corresponds to the maximum width of a longitudinally folded paper web train 25. A belt guide 16, 17, 18 or 19 for its associated paper web draw in means, such as belts 21, 22, 23 or 24, is disposed at a distance "c" from one end of the funnel folding rollers 22 and 23, as seen in FIG. 1. This distance "c" is preferably between 0.1 to 0.5 times a length "l" of each of the funnel folding rollers 2 and 3, for example. Instead of placing separate belt guides 16, 17, 18 and 19 between the various funnel folder roller elements 8, 9 and 10 or 12, 13 and 14, it would also be possible to form annular grooves in the funnel folding rollers 2 and 3. In such an arrangement, each of the folding rollers 2 and 3 would be fixedly secured to its respective drivable shaft 6 or 7.

Again referring to both FIGS. 1 and 2, each of the drivable shafts 6 and 7 has a pair of opposing shaft ends 31 and 32 or 33 and 34. All of these shaft ends for the shafts 6 and 7 of the funnel folding rollers 2 and 3 is seated by a roller bearing 35 in a respective separate sliding pad 36 and 37 or 38 and 39, respectively. These various sliding pads are depicted most clearly in FIG. 2 where it will be seen that each sliding pad 36, 37, 38 and 39 is displaceabley disposed between spaced upper and lower pad guide strips 51 and 52 or 53 and 54. These pad guide strips are supported by their respective left and right lateral frame members 82 and 83 with each such pad guide strip 51, 52, 53 and 54 having a generally rectangular cross-sectional shape and extending generally horizontally and at right angles to its respective ends of drivable shafts 6 and 7.

On one of its ends 31 or 32 and 33 or 34, each of the folding roller shafts 6 and 7 is connected, by way of a suitable flexible coupling 41, with its associated drive motor 42 or 43. These two drive motors 42 and 43 may each be, for example, an electric motor. Each of these electric drive motors 42 and 43 is flanged or otherwise connected to a cover 44 or 46 which extends between, and connects the respective sliding pads 36 and 37. As may be seen by now referring to FIG. 3, each of the folding roller drive motors 42 and 43 is electrically connected by a suitable power unit 47 or 48 with a computer 49 that is a part of the control assembly for the rotary printing press in which the present invention is disposed. The computer 49 is generally conventional in operation and is provided with a suitable memory. The computer 49 can be situated at the control station for the printing press. If the press is operating on d.c. current, each power element could consist of suitable thyristors. If the press is operating on a.c. current, each power element can consist of IGBT's or insulated gate bipolar transistors.

Figure 3:
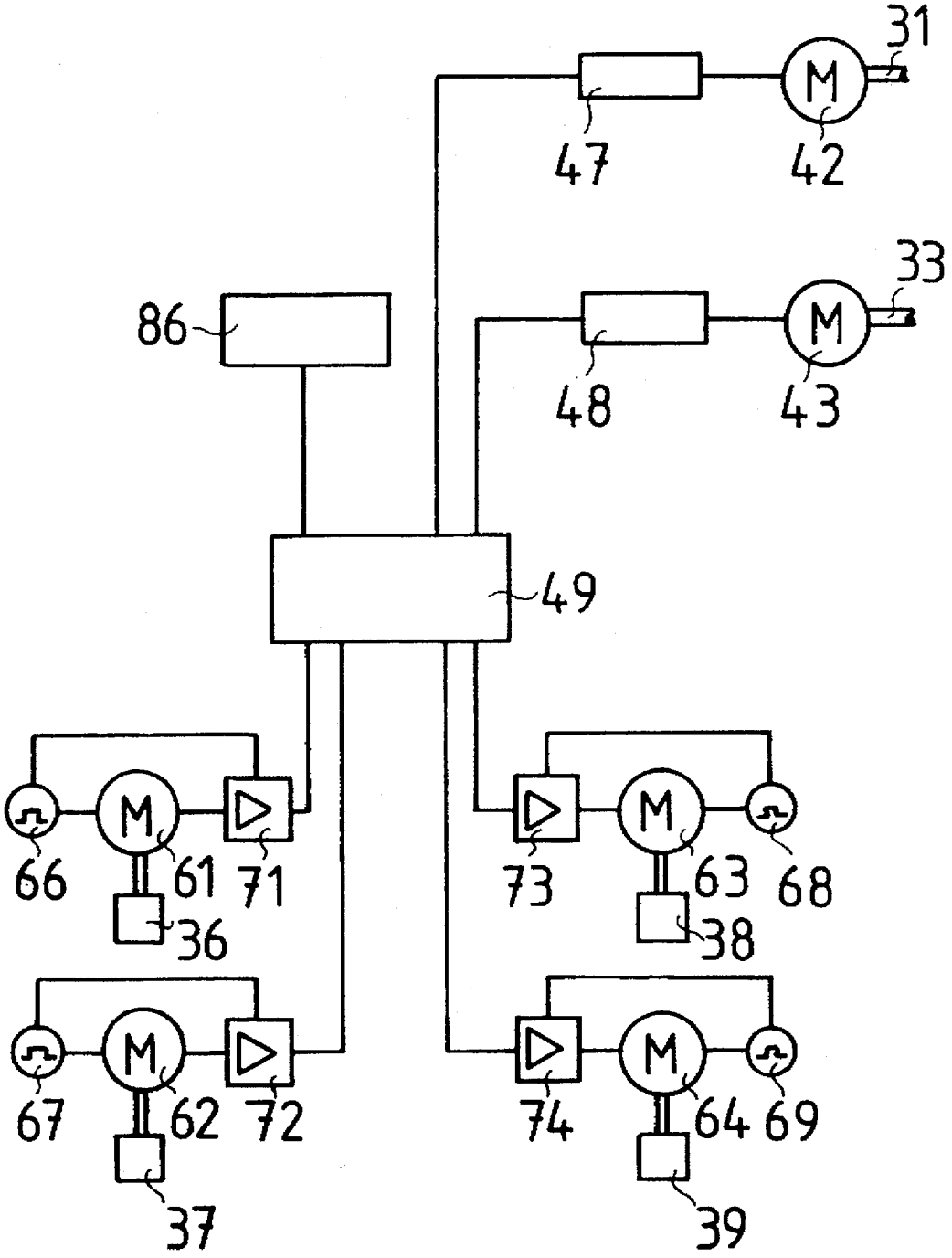
FIG. 3 is a wiring diagram for the folding roller drives and showing the connections of the motor drives and the servo motor controls with a computer.

As may be seen in both FIGS. 1 and 2, each of the sliding pads 36 and 38 or 37 and 39 for the two drivable shafts 6 and 7 respectively, are displaceably disposed between the sliding pad guides 51 and 52 or 53 and 54. Each sliding pad is shiftable in the pad guides by operation of its individually associated servo motor 61, 62, 63 or 64, respectively. Each servo motor drives a threaded spindle 56 which is received in a threaded bore in its associated sliding pad. Each of these threaded spindles 56 is, as may be seen most clearly in FIG. 1, supported by a bearing block 57 that is disposed between the pad guides. A toothed beveled gear pair 58 connects the threaded spindle 56 for each sliding pad to an output drive shaft 59 for each of the servo motors 61, 62, 63 and 64. Each of these servo motors is provided with a suitable angle of rotation position sensor 66, 67, 68 or 69, respectively. Each servo motor and its associated angular position sensor 61 and 66, or 62 and 67, or 63 and 68, or 64 and 69 is respectively connected through a drive regulator 71, 72, 73 or 74, respectively with the computer unit 49, as is shown in FIG. 3. This allows each of the servo motors 61–64 to be operated under control of the central computer 49 to shift its associated sliding pad and hence the end of the particular folding roller shaft 6 or 7 along the lateral frames 82 or 83 to set and to vary the width of a folding roller gap 84.

Each shaft end 31, 32, 33 or 34 of the shafts 6 and 7 is associated with a graduation or scale 76 that is placed on top of the appropriate upper sliding pad guide 51 or 53, respectively, as may be seen most clearly in FIG. 1. A suitable pointer 77 is located on each of the sliding pads 36–39 and is cooperatively positioned with respect to its associated scale 76. In an emergency, the position of each sliding pad can be accurately set using each sliding pad's associated scale 76 and pointer 77. The threaded spindle 56, which is used to shift each associated sliding pad, can be turned by operation of a manual handwheel 78 that is located on each of the four servo motors 61 to 64, as seen in FIG. 1.

The left sliding pad guide strips 51 and 52 are supported by the left lateral frame member 82 by use of a generally L-shaped support bracket 79, which is shown in FIG. 2. The vertical leg of the support bracket 79 is provided with generally elongated or ovoid slots that receive suitable adjustment screws or bolts 81 with clamping heads. The horizontal leg of the L-shaped support bracket 79 is secured by screws 81 to the lower sliding pad guide 52. These strip-shaped sliding pad guides 51 and 52 or 53 and 54 are connected to each other at their ends.

Because of the provision of the L-shaped support bracket 79 for the left sliding pad guides 51 and 52, it is possible to incline the left ends of the funnel folding rollers 2 and 3 up or down. This upward or downward shifting of the left ends 31 and 33 of the shafts 6 and 7 of the funnel folding rollers 2 and 3 is for the purpose of letting the lateral edges of the incoming paper train 25, respectively, enter parallel with the side frame 82. It would also be possible to attach a similar L-shaped support bracket to the right lateral frame 83 and to thereby vary the height of the right ends 32 and 34 of the drivable shafts 6 and 7 which support the funnel folding rollers 2 and 3.

The operation of the funnel folding roller assembly for the longitudinal folding funnel 4 of a rotary printing press in accordance with the present invention will now be discussed. During start-up of the printing press, the funnel folding rollers 2 and 3 are driven by their associated drive motors 42 and 43 at a circumferential speed that is slightly in excess of the draw-in speed paper web train 25. This start up speed of the funnel folding rollers 2 and 3 may be approximately 10% greater than the paper web draw-in speed. The beginning of the paper web train 25 is guided by the guide belts 21 to 24 which are moving over the guide belt rollers 27 which are supported between the funnel roller segments 6, 9 and 10, and 12, 13 and 14 of the funnel folding rollers 2 and 3, respectively.

As has been discussed previously, the setting of the folding roller gap 84 between the two folding rollers 2 and 3 is accomplished through the entry of proper commands to the computer 49 through the entry device 86, which is typically a keyboard. This activates the four servo motors 61 to 64 so that the sliding pads 36, 37, 38 and 39 can be shifted between the sliding pad guides 51 and 52, or 53 and 54 along the left or right lateral frames 82 or 83. As has been also discussed above, the setting of the sliding pads can also be accomplished by use of the handwheels 78 and the scales 76 in cooperation with the printers 77. The set values for the width of the folding roller gap 84 are forwarded by each angle of rotation sensor 66 to 69, which is associated with its servo motor 61–64, to the computer unit 49 where they are stored in the computer's memory and are associated with a particular production number. If the same production is to be run again at a later time, the funnel folding rollers 2 and 3 can be set to the appropriate folding roller gap 84 by the computer unit 49 controlling the rotation of the servo motors 61–64, as measured by the angle of rotation sensors 66–69. As discussed previously, in case of a computer failure, the folding roller gap 84 can be set by use of the handwheels 78, using the graduation scales 76 and the pointer 77.

While a preferred embodiment of a funnel folding roller for a rotary printing press in accordance with the present invention has been set forth fully and completely hereinabove, it will be apparent to one of skill in the art than a number of changes in, for example, the overall size of the assembly, the type of printing being done, the drive for the printing press generally and the like could be made without departing from the true spirit and scope of the present invention which is accordingly to be limited only by the following claims.

What is claimed is:

1. A funnel folding roller assembly for a longitudinal fold former of a folding apparatus in a web-fed rotary printing press comprising:

first and second folding rollers defining a folding roller gap;

paper web draw-in belts associated with at least one of said first and second folding rollers; and at least one paper web draw-in belt guide associated with said at least one of said first and second folding rollers and freely rotatable with respect to said associated roller.

2. The funnel folding roller assembly of claim 1 wherein said folding rollers are driven.

3. The funnel folding roller assembly of claim 1 further including an RPM regulated drive motor for each of said first and second folding rollers.

4. The funnel folding roller assembly of claim 1 further including a support shaft for each of said first and second folding rollers, said at least one belt guide being supported on said shaft for each associated roller.

5. The funnel folding roller assembly of claim 1 wherein each of said first and second folding rollers is transversely divided into at least first and second folding roller elements.

6. The funnel folding roller assembly of claim 5 wherein said belt guide is disposed between said first and second folding roller elements of said associated folding roller.

7. The funnel folding roller assembly of claim 5 further including a support shaft for each of said first and second folding rollers and wherein each of said folding roller elements is connected, fixed against rotation to said support shaft for said associated one of said first and second folding rollers.

8. The funnel folding roller assembly of claim 1 wherein each said belt guide is seated in an annular groove in said associated one of said folding rollers.

9. The funnel folding roller assembly of claim 1 further including a support shaft for each of said first and second folding rollers and a drive motor for each said shaft.

10. The funnel folding roller assembly of claim 9 further including a drive coupling between each said drive motor and each said shaft.

11. The funnel folding roller assembly of claim 1 wherein said at least one belt guide is an outer race of a ball bearing assembly.

12. The funnel folding roller assembly of claim 11 wherein said outer race has lateral runs.

13. The funnel folding roller assembly of claim 1 further including a support shaft for each of said first and second folding rollers, each of said support shafts having first and second support shaft ends, and a plurality of sliding pads and sliding pad drives secured on side frames of said press, each of said support shaft ends being received in one of said plurality of sliding pads, each of said sliding pads being shiftable in said side frame by operation of one of said sliding pad drives.

14. The funnel folding roller assembly of claim 13 wherein each of said sliding pad drives includes a threaded spindle engaging said sliding pad and a servo motor driving said threaded spindle, and further including an angle of rotation sensor on each said servo motor.

15. The funnel folding roller assembly of claim 14 further including a computer and a drive regulator for each said servo motor, all of said servo motors being controllable by said computer through said drive regulators.

* * * * *